US006540578B1

(12) United States Patent
Billon

(10) Patent No.: US 6,540,578 B1
(45) Date of Patent: Apr. 1, 2003

(54) TOY BALLOON

(76) Inventor: Pierre Billon, 30 avenue Louis Colmard, 38560 Champ sur Drac (FR)

( * ) Notice: Subject to any disclaimer, the term of this patent is extended or adjusted under 35 U.S.C. 154(b) by 0 days.

(21) Appl. No.: 09/869,634

(22) PCT Filed: Dec. 13, 1999

(86) PCT No.: PCT/FR99/03115

§ 371 (c)(1),
(2), (4) Date: Jul. 24, 2001

(87) PCT Pub. No.: WO00/43092

PCT Pub. Date: Jul. 27, 2000

(30) Foreign Application Priority Data

Jan. 19, 1999 (FR) ..... 99 00667

(51) Int. Cl.[7] ..... A63H 33/00
(52) U.S. Cl. ..... 446/220
(58) Field of Search ..... 446/220, 221, 446/222, 224, 225, 223; 383/3; 206/522

(56) References Cited

U.S. PATENT DOCUMENTS

| | | | | |
|---|---|---|---|---|
| 2,323,629 A | | 7/1943 | Spanel | |
| 2,724,924 A | * | 11/1955 | Ingram | 383/3 |
| 2,824,407 A | | 2/1958 | Ebel | |
| 4,976,649 A | * | 12/1990 | Mandell | 156/253 |
| 5,628,091 A | * | 5/1997 | Mueller | 24/129 B |
| 6,007,403 A | * | 12/1999 | Urspringer et al. | 24/30.5 S |

FOREIGN PATENT DOCUMENTS

GB 628889 A 9/1949

* cited by examiner

*Primary Examiner*—Jacob K. Ackun
(74) *Attorney, Agent, or Firm*—Oliff & Berridge, PLC

(57) ABSTRACT

The inventive balloon comprises an inflatable pocket (2) and an end piece (4) provided with an opening (6) that enables the pocket (2) to be inflated. An elastic buckle-shaped fastener (10) is fixed onto the end piece (4).

4 Claims, 1 Drawing Sheet

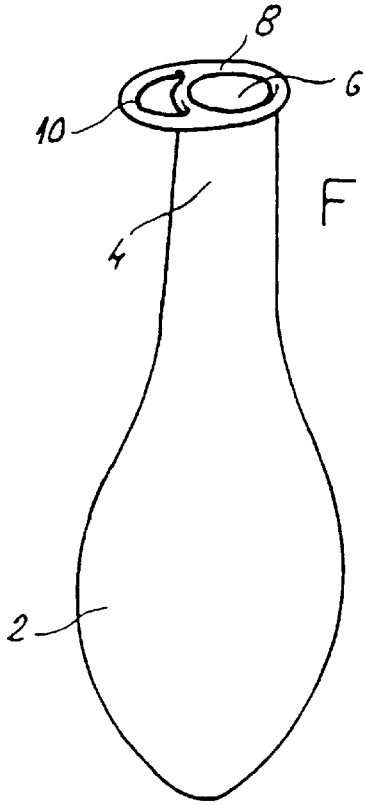
FIG1
FIG 2
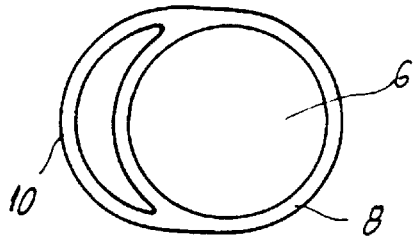
FIG3
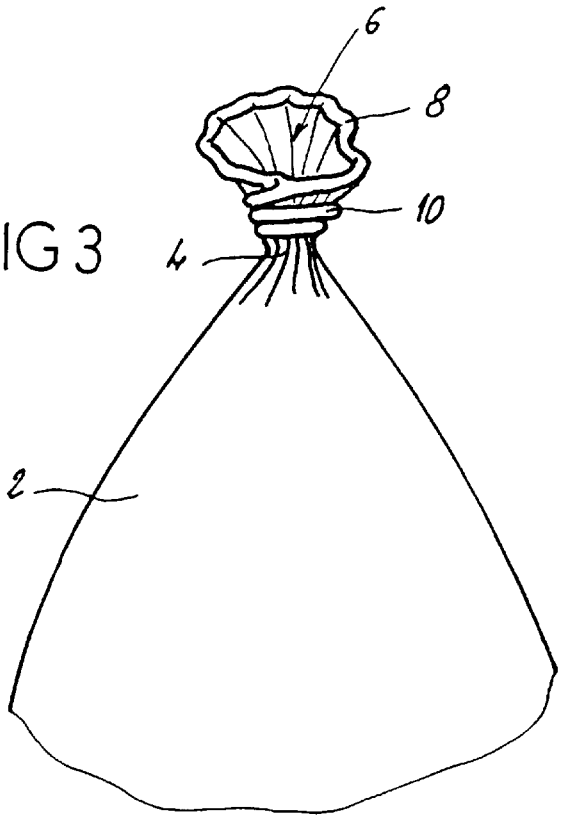

TOY BALLOON

The present invention relates to a toy balloon or the like.

A balloon of this kind comprises a bag made from an elastic material, such as rubber, and a neck to enable the bag to be inflated. The neck has an opening to allow the introduction of a fluid, preferably air or helium, in order to inflate the balloon. The opening is provided at its periphery with a narrow bead which enables the neck to be held during the inflation. Inflation can be carried out either by the mouth, or with the aid of a pump. A balloon of this kind is generally made in one piece.

Once the balloon is inflated, the fluid under pressure which it contains must be kept inside the bag. Many ways exist for then closing the neck and preventing the escape of the fluid introduced into the bag. One example is to throttle the neck with a fastener or an elastic band. The neck can also be tied into a knot. There are also ties capable of both closing the neck and attaching the inflated balloon to a support.

All these solutions require a certain manual dexterity and/or an independent accessory, the cost price of which is sometimes greater than the cost price of the toy balloon itself.

It is therefore an object of the present invention to provide a toy balloon that is easy to close. The price difference between this balloon and a toy balloon of the prior art will preferably be as small as possible.

To this end, the balloon which it proposes is a toy balloon comprising an inflatable bag and a neck that has an opening allowing inflation of the bag. According to the invention, an elastic tie in the form of a loop is attached to the neck.

Thus, it becomes easy to close the balloon. The tie is accessible to the fingers when the balloon is inflated and it is already positioned with respect to the balloon neck. A simple action is then sufficient to close the neck and prevent the fluid introduced into the bag from escaping.

In a preferred embodiment, the tie lies in the continuation of a peripheral bead surrounding the opening of the neck, thus forming a bead whose shape recalls that of an 8.

The tie is advantageously fixed to the opening at two roughly diametrically opposite points thereof. There is thus easy access to the tie.

It is possible for the tie to be made from the same material as the rest of the toy balloon.

The tie may for example be overmolded onto the neck of the balloon.

However, the invention will be clearly understood with the aid of the following description, referring to the accompanying schematic drawing showing by way of non-restrictive example a preferred embodiment of a toy balloon according to the invention.

FIG. 1 is a perspective view of a toy balloon according to the invention,

FIG. 2 is a top view on an enlarged scale of the neck of the balloon of the previous figure, and FIG. 3 is a partial view of the balloon shown in FIG. 1, inflated and with the neck closed.

FIG. 1 shows a toy balloon according to the invention. This balloon comprises an inflatable bag 2 made of an elastic material, and a neck 4.

The neck 4, in a known manner, is integral with the bag 2. It possesses a generally circular opening 6 that allows the bag 2 to be inflated by introducing a fluid under pressure, air or helium for example. The opening 6 is provided at its periphery with a bead 8 made of the same material as the rest of the toy balloon.

In addition to these known elements, the toy balloon shown in the drawing also includes a tie 10 which is fixed to the neck 4 at the bead 8. FIG. 2 shows a top view of the bead 8 and the tie 10. The latter is made of the same material as the bead 8 and has roughly the same cross section. It is attached to the bead 8 at two roughly diametrically opposite points of the bead. The tie 10 thus forms a loop close to the roughly circular opening 6, and the bead 8 and tie 10 together resemble in shape an 8.

There are several ways in which the tie 10 can be fixed to the bead 8. It may for example be bonded or overmolded.

The tie 10 has elastic properties similar to those of the bead 8, which is itself made of the same material as the bag 2. It enables the neck 4 to be throttled so as to prevent the escape of the fluid introduced under pressure into the bag 2. FIG. 3 shows a possible way of throttling the neck 4. The tie 10 surrounds the neck 4 several times, as would be done with a piece of string or an elastic band independent of the balloon to close it. There are other ways of closing the opening 6. For example, the neck 4 can be folded in two so that the bead 8 is towards the bag 2, and the neck can then be fastened in this position using the tie 10. Each user will find the method best suited to himself for throttling the neck and keeping the balloon inflated.

The presence of the tie 10 makes it easy to close off the passage of fluid towards the bag 2 through the neck 4. Following inflation of the bag 2, the tie is immediately available. It simply requires "knotting" about the neck 4 in order to close the opening 6. There is no need to hunt about for an external tie or other means of keeping the opening closed.

The balloon according to the invention also has the advantage of being reusable: provided an inextricable knot is not made, the tie can easily be undone and returned to its initial position. The toy balloon can then be saved and used again later.

As is self-evident, the invention is not limited to the embodiment described above by way of non-restrictive example; on the contrary, it encompasses all variants thereof within the scope of the following claims.

For example, the tie is not necessarily level with the bead. It could be situated immediately beneath the bead or at a distance from it.

Similarly, the shape of the tie may also vary. Its cross section may differ from that of the bead. It may be circular in shape and may be on the side of the bead, overlap the bead or surround the bead.

If level with the bead, the tie is not necessarily connected at two roughly diametrically opposite points. It may start at one point and return to this point, or return to any other point on the periphery of the opening.

The material chosen for the tie is the same as that of the bag and neck. It is of course possible to opt for another elastic material.

What is claimed is:

1. A toy balloon comprising:

an inflatable bag with a neck that has an opening and an elastic tie in the form of a loop attached to the neck, wherein the tie is a continuation of a peripheral bead surrounding the opening of the neck, thus forming a bead whose shape resembles that of an 8 and the tie is made from the same material as the rest of the toy balloon.

2. The toy balloon according to claim 1, characterized in that the tie (10) is fixed to the opening (6) at two roughly diametrically opposite points thereof.

3. The toy balloon according to claim 1, characterized in that the tie (10) is overmolded onto the neck (4) of the balloon.

4. The toy balloon according to claim 2, characterized in that the tie (10) is overmolded onto the neck (4) of the balloon.

* * * * *